United States Patent [19]

Matsumoto

[11] Patent Number: 4,566,384

[45] Date of Patent: Jan. 28, 1986

[54] INTAGLIO PRINTING PLATE AND PRINTING METHOD

[75] Inventor: Katsutoshi Matsumoto, Kyoto, Japan

[73] Assignees: Dainippon Screen Mfg. Co., Ltd., Kyoto; Toray Industries, Inc., Tokyo, both of Japan

[21] Appl. No.: 660,251

[22] Filed: Oct. 12, 1984

Related U.S. Application Data

[63] Continuation of Ser. No. 458,981, Jan. 18, 1983, abandoned, which is a continuation of Ser. No. 213,114, Dec. 4, 1980, abandoned.

[51] Int. Cl.[4] ..... B41C 1/00; B41N 1/00; B41M 1/10; B41F 9/00

[52] U.S. Cl. ..... 101/170; 101/395; 101/150

[58] Field of Search ..... 101/170, 150, 151, 171, 101/163, 376, 395, 401.1; 156/655, 657, 662, 638, 905, 59

[56] References Cited

U.S. PATENT DOCUMENTS

| | | | |
|---|---|---|---|
| 1,661,573 | 3/1928 | Mitchell | 101/170 X |
| 2,531,036 | 11/1950 | Goettsch | 101/170 |
| 3,241,486 | 3/1966 | Greubel . | |
| 3,678,850 | 7/1972 | Gundlac | 101/170 |
| 3,894,873 | 7/1975 | Kobayashi et al. . | |
| 3,949,142 | 4/1976 | Doggett . | |
| 3,953,212 | 4/1976 | Miyano et al. . | |
| 4,005,654 | 2/1977 | Gundlac | 101/170 |
| 4,086,093 | 4/1978 | Ezumi et al. . | |
| 4,112,841 | 9/1978 | Deshpande | 101/141 |
| 4,269,654 | 5/1981 | Deckert | 156/657 |

FOREIGN PATENT DOCUMENTS

| | | | |
|---|---|---|---|
| 2500612 | 7/1975 | Fed. Rep. of Germany | 101/170 |
| 247841 | 8/1925 | United Kingdom . | |
| 659924 | 10/1951 | United Kingdom . | |
| 746145 | 3/1956 | United Kingdom . | |
| 788635 | 1/1958 | United Kingdom | 101/170 |
| 1146618 | 3/1969 | United Kingdom . | |
| 1438567 | 6/1976 | United Kingdom | 101/170 |
| 2034911 | 6/1980 | United Kingdom . | |

*Primary Examiner*—J. Reed Fisher
*Attorney, Agent, or Firm*—Brumbaugh, Graves, Donohue & Raymond

[57] ABSTRACT

An intaglio printing plate having an elastic rubber layer, a photo-sensitive layer and an oil-repellent layer, which are laminated in order onto the base plate. The recesses on the plate face, which correspond to the image line section, is formed by removing the surface to a desired depth depending on the printing purpose. And also, the intaglio printing process to the hard object to be printed by means of this printing plate.

8 Claims, 7 Drawing Figures

INTAGLIO PRINTING PLATE AND PRINTING METHOD

This application is a continuation of application Ser. No. 458,981 filed on Jan. 18, 1983 now abandoned which in turn is a continuation of application Ser. No. 213,114 filed Dec. 4, 1980, now abandoned.

BACKGROUND OF THE INVENTION

This invention relates to an intaglio printing plate and the printing method, more specifically, to the intaglio printing plate that enables thick film printing on a surface of hard materials and the printing method by means of such printing plate.

The printing method applied so far to thick film printing includes screen printing and transfer printing by rubber sheet. By these methods, however, film thickness of image line, pattern accuracy and dimensional accuracy have not reached the satisfactory level yet. In screen printing, for example, a screen is stretched between frames and the screen meshes other than the image are broken manually or by a photographic method to make it into a printing plate, then printing ink is forced through the screen mesh by squeezing for printing. This method has such disadvantages as broken line of image pattern, disordered edge or unstable dimension accuracy due to forced squeezing, since the ink is transfered through the mesh. With transfer printing by rubber sheet, on the other hand, ink is transfered to the surface of an elastic rubber sheet then is transcribed again directly onto the surface to be printed. This method has such disadvantages as distortion of image line or low dimensional accuracy for wide area printings, because the transfer is made by the elastic pressure of the rubber sheet. While, offset printing has long been used popularly as a highly productive printing method because of simple plate making. This is applicable to the printing on paper in general and to thin film printing, but is hardly applied to thick film printing. The reason is that the mechanism does not allow the thick film printing without pinholes and without irregular reproduction. In the following, the reason is described referring FIG. 1.

FIG. 1 shows the principle of ink transfer mechanism in offset printing. Being as such, the plate cylinder, inking arrangement and others are omitted. The object to be printed 12 is impressed by the impression cylinder 11 and the blanket cylinder 13, and the ink 14 transfered from the plate cylinder (not illustrated) is transcribed onto the surface of the blanket cylinder 13 as being exposed. This applies equally to letterpress printing, intaglio printing and also lithographic printing. The ink 14 transferred onto the blanket cylinder 13 easily flows out when subjected to the printing pressure $P_1$ at transcription. The effluent ink divides into three parts: the first part 15*a* is the ink held tentatively on the elastic blanket 13 to be turned into the correct transcript image, a part of which remains on the blanket; the second part 15*b* is the ink forced out of the image position along the boundary between the blanket 13 and the object 12 causing irregular reproduction; and the third part 15*c* is the ink absorbed and fixed into the object to be printed 12. The irregular reproduction is, therefore, resulted because the ink is subjected to the printing pressure $P_1$ while it is exposed on the blanket cylinder 13. The thicker the printing film is required, the higher the ink height H transferred onto the blanket 13 is. Accordingly, the ink for irregular reproduction rises, and then the printing quality becomes lower. Furthermore, when the object to be printed is of non-absorbing nature such as metal or glass, the part of irregular reproduction will be proportionally larger because the part 15*c* is not absorbed into the object 12. To reduce such irregular reproduction of image line, various contrivances have been tried as to make the ink harder or to reduce overall printing pressure by controlling printing speed. Such contrivances, however, are not favorable in that the printed matter has many pinholes and is blurred, since these are consequently to minimize the printing pressure.

As mentioned above, quality evaluation of printed matters contains the antinomy of the faithfulness to the original plate i.e. the problem of irregular reproduction and the thickness of image line i.e. the problem of blurring, so offset printing in which the ink is transcribed onto the blanket cylinder as being exposed is not suitable essentially for thick film printing.

For thick film printing, it is essential that the quantity of ink can be controlled freely depending on the purpose of printing. Screen process printing and intaglio printing are the methods that can realize this. The screen process printing, however, has a disadvantage as mentioned above, in which the printing accuracy is not stable due to the squeezing pressure. In the intaglio printing, on the other hand, it is impossible to print directly onto hard materials, such as metal or glass, since the printing plate of this is made of metallic hard material.

For thick film printing on hard materials, there is no other way but to employ an indirect method that requires transferring the ink from metallic intaglio printing plate once onto a rubber blanket, then transcribing it again onto the object to be printed. After all, this is the same principle as that of offset printing and still includes the antinomy of irregular reproduction and blurring.

BRIEF SUMMARY OF THE INVENTION

In view of the foregoing, it is a general object of this invention to offer the intaglio printing plate that enables clear thick film printing with no irregular reproduction and blurring. And, another object of this invention is to offer the intaglio printing plate that enables the thick film printing onto a hard surface, such as metal or glass, as well as the printing method by means of such a printing plate.

DETAILED DESCRIPTION OF THE INVENTION

Figure 1:
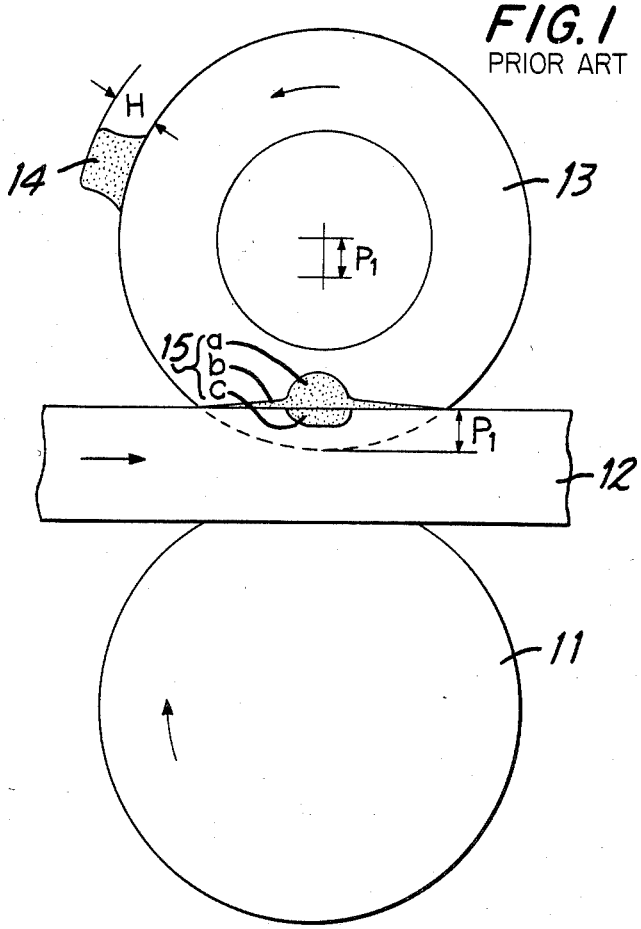
FIG. 1 PRIOR ART
FIG. 1 is the schematic cross-sectional view of the conventional offset printing.
Figure 2:
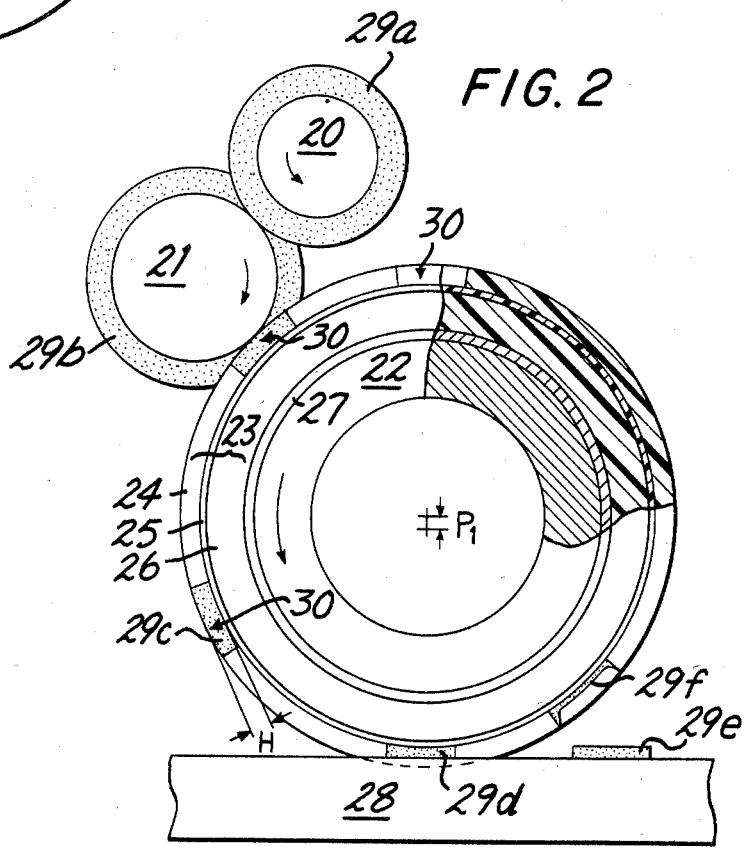
FIG. 2 is the schematic cross-sectional view of the intaglio printing plate according to the present invention.

Referring to FIG. 2, which shows the printing condition utilizing the intaglio printing plate according to this invention, ink is supplied onto the printing plate 23 provided on the plate cylinder 22 as it rotates in contact with the form roller 21 which is in contact with the distributing cylinder 20. The printing plate 23 according to the invention is comprised of an elastic oil-repellent layer 24 of 5μ to 20μ in thickness, an elastic photosensitive layer 25, and an elastic rubber layer 26 of 100μ to 1000μ in thickness and 30 deg. to 90 deg. of Shore scale A, which are respectively arranged in order on the support plate 27.

The support plate 27 is made of aluminum formed into a cylinder, and therefore, the printing plate 23 supported by the plate 27 can be fixed to or removed from the plate cylinder 22 easily in the same way as presensitized plate. As is known from the above description, it will be evident that the key point of this invention is not affected at all even if the printing plate 23 comprised of the elastic rubber layer 26, the photosensitive layer 25 and the oil-repellent layer 24 is laminated directly on the plate cylinder 22 because the support plate 27 is to facilitate easy mounting and dismounting of the printing plate 23 to and from the plate cylinder 22.

Figure 4:
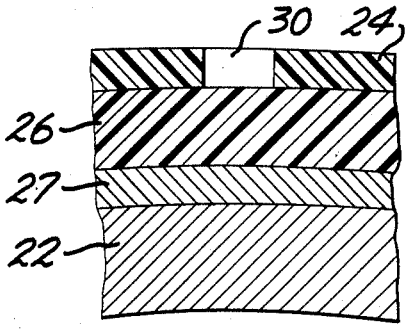
FIG. 4 is the segmentary view of the first embodiment of this invention.
Figure 5:
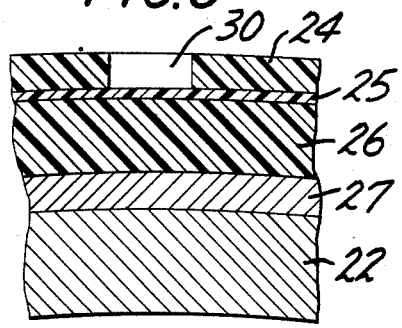
FIG. 5 is the segmentary view of the second embodiment.
Figure 6:
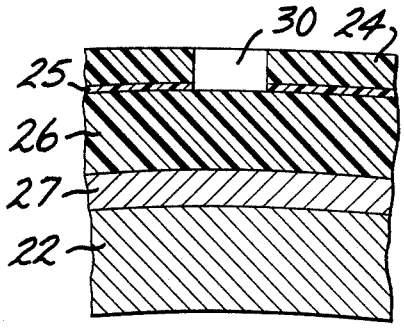
FIG. 6 is the segmentary view of the third embodiment.
Figure 7:
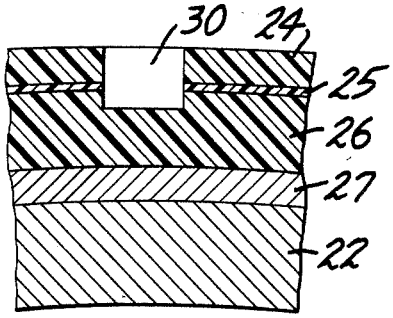
FIG. 7 is the segmentary view of the fourth embodiment.

The recess 30 on the printing plate 23, which corresponds to image line section, can be formed by any one of the following methods:

(1) the method that a part of the oil-repellent layer 24 corresponding to image line is peeled off by irradiation, in which the oil-repellent layer 24 is made of silicone rubber or rubber material with flourine compound to which the photosensitive radical is mixed, as shown in FIG. 4; (2) the method that the non-exposed part of the oil-repellent layer 24 corresponding to image line is removed by swelling dissolution, after adhesion of the oil-repellent layer 24 to the photo-sensitive layer 25 by irradiation, in which the oil-repellent layer 24 is made of silicone rubber or rubber material with flourine compound, and the photo-sensitive layer 25 is made of photo-adhesive material, as shown in FIG. 5; (3) the method that the exposed photo-sensitive layer 25 made by the above method (2) is further dissolved as shown in FIG. 6; (4) the method that the oil-repellent layer 24 and the photo-sensitive layer 25 are removed by turning the layers soluble to solvent, after induction of photolysis of diasonium salt by irradiation, in which the photosensitive layer 25 is made of diaso photo-sensitive material (FIG. 6); (5) the method that the exposed oil-repellent layer 24 and all or a part of the photosensitive layer 25 corresponding to image line are removed, after destruction of adhesion between the oil-repellent layer 24 and the photo-sensitive layer 25 by irradiation, in which the oil-repellent layer 24 is made of silicone rubber or rubber material with flourine compound, and the photo-sensitive layer 25 is made of photo-destructive material (FIG. 6); (6) the method that a part of the elastic rubber layer 26 is removed by organic solvent, further to the method (5), in which it is made of natural rubber, as shown in FIG. 7, and so on.

The elastic rubber layer 26 as the lining to the photosensitive layer 25 can generally be in an extensive range of hardness, from 30 deg. to 90 deg. of Shore scale A, and of thickness, from 100μ to 1000μ.

In other words, the elastic rubber layer 26 is acceptable only if the hardness is such that allows compression easily by the impression at printing and if it has the synatic stability as a rubber elastic body. The support plate 27 is made of such materials as aluminum plate or plastic film to ensure the strength of the whole printing plate, therefore, the printing plate 23 supported by it can easily be fixed to or removed from the plate cylinder 22, as mentioned above. The surface of the printing plate 23 consists of the convex part of the oil-repellent layer 24 and the concave part formed by removing it. Ink is filled only into the concave part, i.e. the recess 30. The recess 30 filled with ink proceeds to printing as the plate cylinder 22 rotates. For the thick printing, the following conditions should be met. The printing plate 23 should hold more quantity of ink than that of film thickness on the object to be printed 28. Practically, at transferring from the printing plate 23 onto the object 28, the ink divides into two parts: part the that remains in the recess 30 and the other part that is transcribed onto the surface of the object 28, When the ink transcribed onto the object is dried, the film thickness will be reduced. The recess 30, therefore, should hold the excessive ink taking the reducing portion into account. As a matter of course, the ink has fluidity, a specified viscosity and non-compressibility. In printing to the object 28, the ink to be transcribed 29 takes the following forms: distributed condition 29*a* on the distributing cylinder 20, inking condition 29*b* over the printing plate 23 from the form roller 21 to fill the recess 30 with ink, held condition 29*c* in the recess 30, printing condition 29*d* onto the object 28, transfered condition 29*e* on the object 28, and remaining condition 29*f* in the recess 30 after printing.

Referring to FIG. 2, the operation of the intaglio printing plate according to this invention is described. When the printing pressure $P_1$ is applied to the plate cylinder 22 from the impression cylinder (not illustrated) through the object 28, in the non-image line section the printing pressure $P_1$ is equal to the compression $P_1$ of the printing plate 23 composed of the oil-repellent layer 24, the photo-sensitive layer 25 and the elastic rubber layer 26 because the plate cylinder 22 and the support plate 27 are both rigid bodies made of metallic materials. This condition is held constantly from the beginning to the end of printing. In the image line section, on the other hand, the ink filled in the recess 30 and the part of the printing plate 23 formed by the photosensitive layer 25 and the elastic rubber layer 26 are subjected to the printing pressure $P_1$. Since the ink has non-compressibility as mentioned above, therefore, the printing plate 23 is to be compressed through the ink. The printing plate 23 subjected to the printing pressure restores elastically, so the ink in the recess 30 will be discharged and transcribed by the repelling power. Though the impression mechanism is to utilize the elasticity of the printing plate 23 in the same manner as offset printing as mentioned above, the intaglio printing plate according to this invention is featured in that the ink is prevented from being forced out of the image line to the sides. In other words, the intaglio printing plate by this invention is compressed while keeping the ink within the recess 30. Compared with offset printing in which the printing plate is compressed with the ink being exposed, the ink is not forced out the image position easily, i.e. the intaglio printing plate according to the invention has the effect to prevent extra ink from forcing out to sides. Moreover, in the embodiments shown by FIG. 6 and FIG. 7, the ink held in the photosensitive layer 25 and/or the elastic rubber layer 26 is discharged by restoration thereof the elasticity of the printing plate 23 because it reaches the holding limitation of the photo-sensitive layer 25 and/or the elastic rubber layer 26. To keep a favorable printing accuracy, it is desirable to set the printing pressure P (mm) at a larger level than the ink film thickness H (mm).

Figure 3:
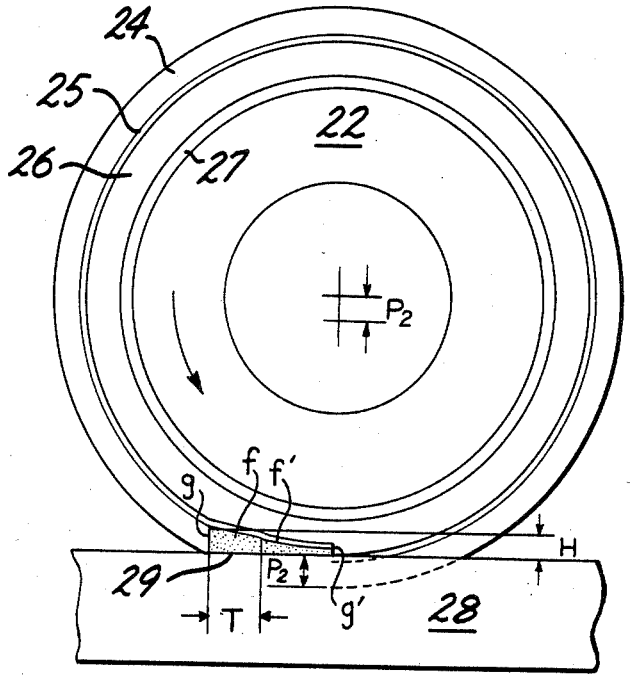
FIG. 3 is also the schematic cross-sectional view of the intaglio printing plate according to this invention.

Referring to FIG. 3, when the printing pressure $P_2$ is applied onto the recess 30, which corresponds to the image line, the restored elasticity $P_2$ of the photo-sensitive layer 25 and the elastic rubber layer 26 is larger than the film thickness $H_2$ in the part f' of the recess 30 close to the boundary g' between the concave and the convex which comes in contact with the object 28 earlier than the boundary g, so the ink in this part f' is subjected to impression. In the part f of the recess 30 close to the boundary g, on the other hand, the ink in this part functions in the same manner as the layers in the non-image line section. That is, receiving the printing pressure $P_2$, the oil repellent layer 24, the photo-sensitive layer 25 and the elastic rubber layer 26 in the non-image line section are forced upwards. The photosensitive layer 25 and elastic layer 26 laminated under the part f are forced depending on the pressure condition of the non-image line section close to the boundary g. The upward movement of the layers by the printing pressure is reduced gradually in proportion to going from the boundary g to the other boundary g', so the printing pressure $P_2$ is directly applied to the part f'. When the non-image line section close to the boundary g is subjected to the printing pressure, the compression force applied to the ink in the part f is reduced because of upward movement of the layers, and therefore, the ink pocket T is formed to prevent the ink from forcing out to the sides.

As described above, the compressed ink will divide into two parts: one is the transferred ink **29*e* on the object 28 and the other is the residual ink 29*f* in the recess 30. The residual ink 29*f* serves to make the next ink feeding into the recess 30 quite smooth. The depth of the ink recess 30 can be decided freely depending on the printing prupose. Practically, the depth of the recess 30** for usual intaglio printing is preferably in the range from $5\mu$ to $20\mu$.

By means of the intaglio printing plate according to this invention, printing onto a comparatively rough surface or a hard surface can be accomplished without spoiling the image quality because of the elastic layers employed as the intermediate bed material.

I claim:

1. An intaglio printing plate for clear, substantially flawless, direct printing on to an object comprising: an ink-repellent outer layer which comprises an ink-repellent material selected from the group consisting of a silicone rubber and a rubber material containing a fluorine compound, a photosensitive layer laminated beneath the outer layer and an elastic layer laminated beneath said photosensitive layer, the plate having ink-accepting recesses corresponding to the image lines, which are formed by removing imagewise at least the ink-repellent outer layer, and the elastic layer having a thickness of 100 to 1000 microns and a hardness of 30 degrees to 90 degrees on the Shore scale A, wherein the elastic layer is compressible in response to printing pressure applied through the ink accepted in the recesses and the ink-repellent outer layer to thereby substantially prevent the ink accepted in the recesses from being forced out of the sides of the recesses.

2. An intaglio printing plate as defined in claim 1 comprising a support plate beneath the elastic layer for supporting said layers.

3. An intaglio printing plate as defined in claim 1 wherein the elastic layer comprises elastic rubber.

4. An intaglio printing plate as defined in claim 1 wherein the recesses are from 5 to 20 microns in depth.

5. An intaglio printing plate as defined in claim 1 wherein the ink-accepting recesses are formed by removing, imagewise, the ink-repellent outer layer.

6. An intaglio printing plate as defined in claim 1 wherein the ink-accepting recesses are formed by removing, imagewise, the ink-repellent outer layer and the photosensitive layer.

7. A method of printing, imagewise, a thick layer of ink directly onto an object having a relatively hard surface to produce a clear, substantially flawless image on the object, comprising the steps of:

applying ink to an intaglio printing plate, the plate comprising an ink-repellent outer layer, a photosensitive layer laminated beneath the outer layer and an elastic layer laminated beneath the photosensitive layer, the plate having ink-accepting recesses corresponding to image lines which are formed by removing imagewise at least the ink-repellent outer layer, and the elastic layer having a thickness of 100 to 1000 microns and a hardness of 30 degrees to 90 degrees on the Shore scale A wherein the elastic layer is compressible in response to printing pressure applied through the ink accepted in the recesses and the ink-repellent outer layer to thereby substantially prevent the ink accepted in the recesses from being forced out of the sides of the recesses;

and pressing the plate holding ink in the recesses directly onto the object with sufficient force to compress the elastic layer, thereby transferring the ink imagewise and directly onto the surface of the object.

8. A method of printing as defined in claim 7 wherein the pressing step is carried out at a printing pressure larger than the thickness of the ink accepted in the recesses.

* * * * *